United States Patent [19]

Brady et al.

[11] Patent Number: 4,668,315

[45] Date of Patent: May 26, 1987

[54] SILICONE ELASTOMER BASED ROOFING SYSTEM

[75] Inventors: Sam A. Brady; Michael G. Elias; Alan L. Freiberg, all of Midland, Mich.

[73] Assignee: Dow Corning Corporation, Midland, Mich.

[21] Appl. No.: 503,381

[22] Filed: Jun. 10, 1983

Related U.S. Application Data

[63] Continuation-in-part of Ser. No. 288,268, Jul. 30, 1981, abandoned.

[51] Int. Cl.[4] ..... E04B 2/00

[52] U.S. Cl. ..... 156/71; 52/309.1; 52/746; 156/278; 156/280; 156/304.6; 156/307.1; 156/307.3; 156/329; 427/316; 428/266

[58] Field of Search ..... 156/71, 94, 278, 280, 156/304.6, 307.1, 307.3, 308.2, 329, 322; 428/142, 145, 192, 266; 427/387, 316; 52/309.1, 746

[56] References Cited

U.S. PATENT DOCUMENTS

| | | | |
|---|---|---|---|
| 3,119,708 | 1/1964 | Munck | 427/316 |
| 3,275,487 | 9/1966 | Lemelson | 156/72 |
| 3,619,314 | 11/1971 | Ecureux | 156/71 |
| 3,996,396 | 12/1976 | Hansen et al. | 156/280 |
| 4,051,218 | 9/1977 | Hotton | 156/304.6 |
| 4,221,688 | 9/1980 | Johnson et al. | 525/119 |
| 4,297,265 | 10/1981 | Olsen | 260/33.65 B |
| 4,370,365 | 1/1983 | Takamizawa et al. | 428/266 |

FOREIGN PATENT DOCUMENTS

| | | | |
|---|---|---|---|
| 0062327 | 6/1978 | Japan | 156/278 |
| 0166236 | 12/1980 | Japan | 428/266 |

OTHER PUBLICATIONS

Application Guide Specification, Single Ply & Silicone Roof System, OTTO STR 1980.

*Primary Examiner*—John J. Gallagher
*Attorney, Agent, or Firm*—Edward C. Elliott

[57] ABSTRACT

A method of constructing a weatherproof coating over a roof comprises laying a piece or pieces of cloth over a roof, bonding the pieces of cloth together at any seams, adhering the cloth to the roof surface at least at the edges and projections, then coating the cloth with a liquid elastomeric silicone composition. The composition cures under ambient conditions to yield a water impermeable membrane that has been manufactured in place. A preferred embodiment uses unimpregnated, non-woven thermoplastic cloth having an upper surface thermally treated to remove projecting fibers, the thermally treated surface being subsequently wash coated with a layer of liquid elastomeric silicone emulsion except for any surface of the cloth edges which will be subsequently bonded at any seams, the wash coating being cured before application of the coated cloth to the roof.

9 Claims, 7 Drawing Figures

SILICONE ELASTOMER BASED ROOFING SYSTEM

This is a continuation in-part of application Ser. No. 288,268, filed July 30, 1981, now abandoned.

BACKGROUND OF THE INVENTION

1. Field of the Invention

This invention relates to a method of providing a water impervious membrane covering for a roof by coating a cloth with silicone elastomeric compositions.

2. Description of the Prior Art

Many systems have been devised for providing a roof covering for buildings. One method uses pieces of water-impervious material, such as slate or wood, layed upon the roof in overlapping rows so that each joint is covered by the piece layed above it. Such shingled roofs are satisfactory when the roof is pitched at a high angle so that there is no tendency for the water to flow back through the cracks between the pieces. Even in these cases, when located in areas where freezing occurs, ice occasionally forms on the lower edges of roofs to form a dam which forces water back through the cracks into the interior of the building.

A method of covering roofs that did not have cracks in them was evolved making use of asphalt as an impregnant and bonding agent along with felts of various fibers. The asphalt in the form of a hot liquid or an emulsion was spread over the roof, then pieces of asphalt impregnated felt were rolled out over it. Another layer was then applied, moving the location of the seams so that they did not occur in the same area. Such built up roofs eliminated the problem of water backing up from ice dams. Built up roofs could also be used when the roof was of a low pitch or flat as there were no cracks for water to back up through. The built up roofs fail due to cracks developing because of exposure to weathering and embrittlement of the felt, oxidation of the asphalt, and expansion and contraction of the system because of temperature changes. During cold weather, the asphalt becomes brittle and easily cracks due to expansion and contraction forces.

Systems have been developed based upon sheets of rubber or plastic intended to correct the problem of failure due to weathering and cracking from temperature changes. The sheets used have some elasticity so that they can move as the underlying structure expands and contracts over the course of the changing seasons. However, there are still problems remaining. Many of the coatings are satisfactory at normal temperatures, but become overly soft at high temperatures or overly hard at very low temperatures.

Because these are also the times that building movements are at a maximum, failures result. The plastic materials tend to lose volatile components and become brittle with age. The rubber-based materials are not always compatible with the underlying roof structure and special steps must be taken to make sure they do not contact asphaltic materials.

A system has been devised which coats the roof structure with a polyurethane foam which insulates the underlying structure. The polyurethane foam cannot withstand the effects of sunlight, so it is covered with an opaque layer of silicone rubber based paint to provide weatherability to the system. The system requires special equipment and skilled operators for installation.

Repairs on roofs have been made by coating a roof surface with a solvent or emulsion based asphalt, rolling down an impregnated glass fiber mat and overcoating with more of the asphalt. Another system involves the simultaneous spraying of asphalt solvent dispersions or aqueous emulsions with chopped glass reinforcement over a saturated felt to give a reinforced membrane. This system is said to provide a simpler roofing system with comparable life to a conventional asphalt and felt built up roof. Experience has shown that systems based on asphalt do not have a satisfactory life without regular maintenance.

SUMMARY OF THE INVENTION

A method of applying a weatherproof covering over a roof is described. The method comprises laying a piece or pieces of unimpregnated, elastic cloth over the roof, then bonding the pieces of cloth together at any seams. The cloth is adhered to the roof surface, at least in a continuous band at all outer edges and at any projections. The cloth, which is now a single piece, is then coated with a liquid, elastomeric silicone composition, the composition being curable under atmospheric conditions. The composition is applied in sufficient amount so that the coated cloth forms a water impermeable membrane when the composition cures.

It is an object of this invention to provide a water impermeable membrane covering a roof, the membrane being continuously bonded to the roof at least at all edges and projections.

It is an object of this invention to provide a water impermeable membrane covering a roof that is elastic at both high and low temperatures so that the roof covering does not crack due to building movement.

It is an object of this invention to provide a water impermeable membrane covering a roof that has a maximum resistance to the effects of weathering.

DESCRIPTION OF THE INVENTION

This invention relates to a method of applying a weatherproof covering over a roof comprising (A) laying a piece or pieces of unimpregnated, elastic cloth over the roof, then, (B) bonding the pieces of unimpregnated, elastic cloth together at any seams, (C) adhering the cloth to the roof surface, at least in a continuous band at all edges and projections, then (D) coating the unimpregnated, elastic cloth with a liquid elastomeric silicone composition in sufficient amount so that the coated cloth forms a water impermeable membrane when cured, the composition being curable under atmospheric conditions, to produce a weatherproof roof.

The method of this invention is designed to be an uncomplicated method, using a variety of silicone elastomeric compositions and cloth reinforcements that can be easily applied to any size roof by unskilled labor. Because only readily available equipment is required for the installation, the cost is at a minimum. The finished water impermeable membrane is bonded to the underlying structure at all edges and projections in a continuous band so that no water can get under the membrane. The membrane is a silicone elastomer reinforced with cloth. The membrane is elastic at both high and low temperatures, therefore it does not crack due to building movements. The silicone elastomer has excellent resistance to weathering effects, therefore the membrane has a long, useful life. If moisture gets under the membrane, such as from a faulty moisture barrier under the roof insulation, the moisture can escape without the use of expensive roof vents. Water vapor can escape through the silicone elastomer, even though it is impervious to liquid water.

Figure 1:
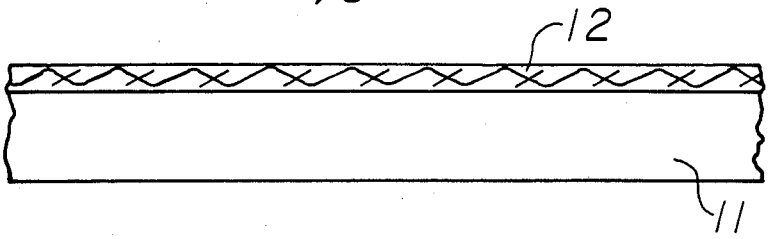
FIG. 1 depicts a roof covered with a liquid water impermeable membrane of cloth and silicone elastomer.

As a preliminary step in the method of this invention, the roof structure is prepared for the subsequent covering by reinforcing cloth. If a new roof is being constructed, the roof deck 11, as shown in FIG. 1, is completed. The finished deck should be reasonably smooth without sharp protrusions which would tend to puncture the membrane to be later applied. The deck can be any of the surfaces used to construct roofs, such as reinforced concrete; nailable, lightweight concrete; poured gypsum; formed metal; and wood, either as planks or as plywood sheets. The customary construction methods are used for installing expansion joints and providing for projections through the roof for pipes, electrical conduit, vents and chimneys.

Figure 2:
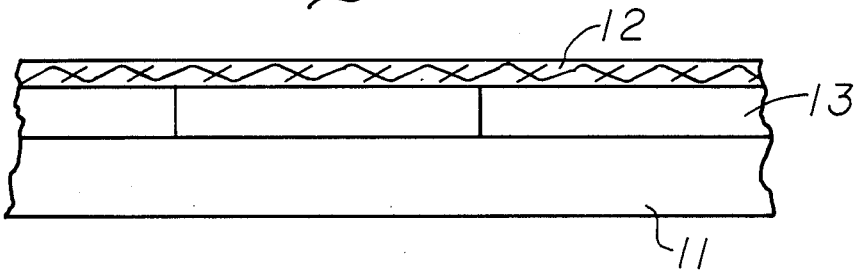
FIG. 2 depicts an insulated roof.

In most cases, there are vapor barriers and insulation layers involved in the roof system. In some cases, the insulation and vapor barriers are applied beneath the roof deck as is most common in residential construction. Commercial buildings often have slightly sloping roofs that have the insulation applied on top of the roof deck. Such a construction is shown in FIG. 2 where the insulation 13 is over the roof deck 11. The reinforced silicone membrane 12 covers the insulation. The insulation applied over the roof deck must be relatively rigid as it will be walked on in applying the reinforced silicone membrane. Typical insulation includes mineral or vegetable fiber boards, rigid glass fiber insulation, glass-bead board, rigid urethane board or sprayed coating, formed polystyrene board, and composite board. The insulation is attached to the roof deck with conventional adhesives or mechanical fasteners.

The method of this invention can also be used to repair roofs which have developed leaks. In the case of built-up asphalt roofs, it is only necessary to remove loose gravel from the old roof if the roof is to be upgraded by applying insulation boards over the old roof surface, because the new roof surface can then be applied to the insulation surface. If no additional insulation is to be added, the old roof surface should have the gravel removed if any is present and any holes or large cracks should be repaired so that a clean and smooth surface is available for the subsequent application of the new weatherproof covering produced by following the method of this invention.

Figure 4:
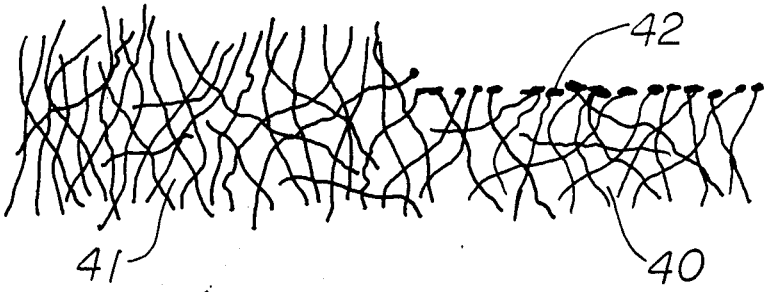
FIG. 4 depicts a cross section of cloth having a portion of the upper surface thermally treated to remove projecting fibers.

The first step in the method of this invention is laying a piece or pieces of unimpregnated, elastic cloth over the roof or insulation. The cloth is described as unimpregnated and elastic to differentiate it from the normal roof covering materials such as shingles or roofing paper where a fibrous cloth or paper is saturated with a material such as asphalt or an elastomeric material to prepare materials to be subsequently applied to roofs. Such materials are essentially saturated with an impregnating material to provide a waterproof sheet. The sheet is subsequently attached to the roof by an adhesive as in the case of a normal built-up roof or by mechanical means such as nailing of shingles, or a combination of both methods. In the method of this invention, because there is no impregnating material on the surface of the cloth which will be placed next to the roof surface, the cloth is easily adhered to the roof surface with a variety of different types of adhesives. The cloth is described as elastic because it can be stretched or distorted to some degree during the process of applying it to the roof surface. Because it is not saturated with an impregnating material, the fibers of the cloth can stretch or distort to allow the cloth to be fitted to the underlying surfaces, but because the cloth is elastic it will remain smooth when it is stretched over small cracks or holes rather than draping down to assume the contour of whatever is underneath it. For instance, the cloth could be placed over an old shingle roof to provide a smooth roof which would not resemble the shingled contour underneath it. The cloth acts as a reinforcement for the silicone elastomeric coating to be applied over it. Any type of unimpregnated, elastic cloth can be used, but some types are more suitable. A preferred type of cloth 40 is shown in cross section in FIG. 4. The base cloth 41 is an unimpregnated cloth constructed of thermoplastic fibers. These fibers are preferred because they do not absorb excessive amounts of water and do not deteriorate with age when protected from the sunlight. Polypropylene and polyester fibers are preferred types of fibers. Because the final membrane functions best when it has elasticity, the reinforcing fibers should be elastic, or the cloth construction should allow for stretching. Nonwoven types of cloth are preferable because of their deformability and generally lower cost as compared to woven or knitted cloth. In a preferred embodiment, the base cloth 41 is thermally treated on one surface by exposing the cloth to a heat source for a short time at a high enough temperature to soften or melt the thermoplastic fibers projecting from the thermally treated cloth surface. This treatment makes the thermally treated cloth surface 42 smoother in that there are no longer fibers projecting upward. The thermally treated surface is the upper surface when the cloth is layed over the roof. When the cloth is subsequently coated with liquid elastomeric silicone composition, the coating that results is much smoother because the cloth does not have fibers projecting upward to create a rough surface on the cured coating.

Figure 5:
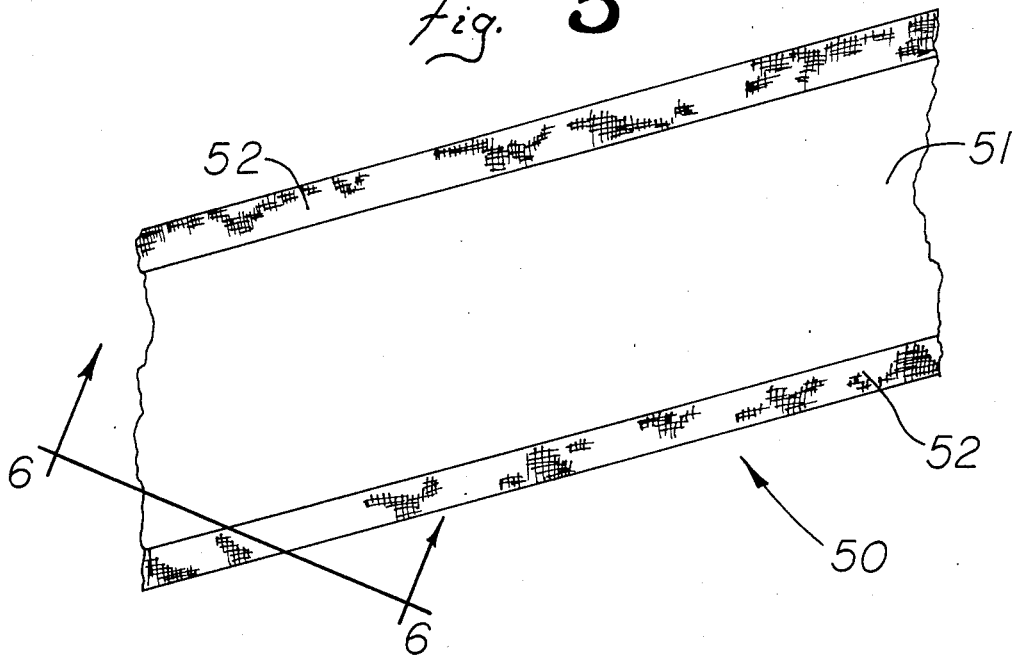
FIG. 5 depicts wash coated, thermally treated cloth having uncoated edges.

A further embodiment using thermally treated cloth is shown in FIG. 5. The thermally treated cloth is wash coated over the majority of the thermally treated surface with liquid, elastomeric silicone composition which is cured to yield the coating 51. The coating 51 of cured silicone elastomer does not extend over the entire surface of the cloth, but leaves the edges 52 uncoated because these edges are bonded together during the process of applying the cloth to the roof surface. The coating 51 is a coating applied to reduce the porosity of the cloth surface. The coating 51 is a layer of cured material on and/or in the upper surface of the cloth, coating the cloth fibers, being in the upper 50 percent of the cloth thickness, and being present in sufficient amount to reduce the porosity of the cloth to less than 50 percent of the original porosity.

Figure 6:
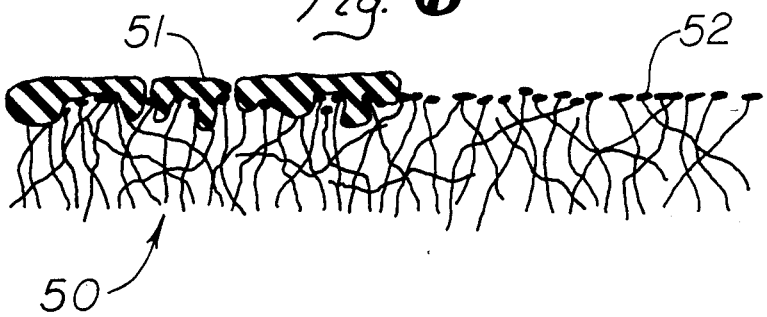
FIG. 6 depicts a cross section of the wash coated, thermally treated cloth of FIG. 5.

FIG. 6 is a cross section of the wash coated, thermally treated cloth 50. The thermally treated cloth has a smooth surface because of the thermal treatment. The coating of cured liquid elastomeric silicone composition 51 is a wash coat applied to the thermally treated surface of the unimpreganted cloth. In the application of the coating 51, the amount and viscosity of the liquid elastomeric silicone composition is such that the surface of the cloth is coated but the composition does not flow down through more than 50 percent of the cloth thickness, preferably less. The wash coat is uniformly applied to the thermally treated cloth to partially seal the surface so that the amount of liquid, elastomeric silicone composition applied in step (D) of this method can be held to a minimum amount in order to form a water impermeable membrane. By sealing or partially sealing the surface of the cloth, the porosity of the cloth is reduced so that the silicone composition applied in step (D) does not soak down into the cloth, but primariy remains on top of the coating 51 and forms an impermeable coating there, without the necessity of having to impregnate the entire thickness of the cloth. The wash coating is not applied over the entire surface of the cloth, the edges 52 are left uncoated so that they can be bonded together during the application of the cloth to the roof surface. Because the lower surface of the cloth, as shown in FIG. 6, does not have any coating, it can be easily adhered to the roof surface with adhesives. The cloth fibers provide an ideal surface to bond to as they are not coated and can provide a porous surface as well as a large surface area to an adhesive.

As the cloth is being layed out over the roof, it can be adhered to the roof surface. It is not required that the entire cloth area be bonded to the surface under it. A commercial elastomeric silicone composition such as a caulk can be applied to the roof surface in a random pattern of spots or lines. The cloth is then placed over the caulk and forced down into the caulk. When the caulk cures, the cloth is bonded to the roof surface.

If the cloth is to be bonded to the entire surface of the roof, a fluid adhesive can be used to coat the roof surface by such means as brushing, rolling, trowelling, or spraying. The adhesive can be of any type that provides a bond to the roof surface and to the under side of the cloth, provided that the adhesive does not adversely effect the cloth being used. For example, a solvent-based adhesive that swelled the fibers of the cloth and caused the cloth to wrinkle would not be acceptable. A solvent-based silicone composition, for example, has been found to function satisfactorily in conjunction with a polyester cloth, but caused a polypropylene cloth to wrinkle. It is preferred that the adhesive generate a tacky surface shortly after it is applied to the roof surface so that it will hold the cloth in place as the cloth is layed down over the adhesive. The dryed or cured adhesive must adhere to both the roof surface and the cloth with sufficient force to prevent the wind from lifting the cloth off the roof surface. The adhesive must also be able to function throughout any temperature extremes at the location. For example, it must not become brittle and crack at low temperatures or become soft or fluid and loose its adhesion at high temperatures. Suitable fluid adhesives include liquid elastomeric silicone compositions such as those described below, styrenebutadiene modified asphalt emulsion adhesives, synthetic latex rubber adhesives, and neoprene adhesives. Aqueous emulsions are preferred as adhesives because they are less toxic and usually less expensive than solvent-based adhesives. Because the cloth surface in contact with the adhesive is not coated, the choice of adhesives that are usable is extended over those that would be usable if the cloth surface were coated. In the case of a coated surface, the adhesive would have to bond to the material used for the coating. If the coating were a silicone elastomer for instance, the choice of adhesive would be limited because few adhesives will adequately bond to a silicone elastomer. Silicone elastomers and resins are well known as providing release coatings.

The adhesive is applied to the roof, then allowed to become tacky. The cloth is then layed over the tacky adhesive to hold it in place, the adhesive being able to flow into the voids of the uncoated cloth surface.

The cloth can also be bonded to the roof surface by mechanical means such as staples or nails being placed through the cloth into the roof surface.

Normally, the area of a roof is such that more than one piece of cloth will be required in order to cover it. As the pieces of cloth are layed out over the roof, they are overlapped at adjoining edges to form a seam. The amount of overlap is conveniently from about 5 cm to 20 cm. The pieces of cloth are bonded together at the seams, either while being layed out or afterward. The method of bonding the pieces of cloth together at the uncoated seam can be selected to best suit the type of fibers used in the cloth. Thermoset or natural fibers can be bonded by sewing or adhesive bonding with adhesives that bond to the fibers used. Thermoplastic fibers can be bonded in the same means and also by heat fusion.

A simple method of bonding the pieces of cloth together at the overlap is adhesive bonding using a commercial elastomeric silicone composition such as a caulk. Many caulks are available for bonding to a great variety of substrates. A preferred caulk is one selected from the class that cures by exposure to the moisture and gives off an alcohol byproduct. The composition is obtainable in storage tubes which are adapted to fit in standard caulking guns. The seams are bonded by extruding a bead of caulk between the adjoining surfaces of cloth at the seam, then pressing the two pieces of cloth together to force the bonding composition to flow out and into the cloth. Upon cure of the composition, the pieces of cloth are bonded together. The seam can be further sealed and smoothed by applying a fillet of the same composition at the exposed cloth edges at the seam.

Another method of bonding the pieces of cloth together at the overlap is adhesive bonding using an elastomeric silicone composition in the form of a liquid that cures at ambient conditions. The composition can be a two package system that is mixed just before use that then cures without heat, or the composition can be a one package system that cures by evaporation of solvent or by exposure to the atmosphere. Several compositions are commerically available. Compositions such as those described in U.S. Pat. No. 3,334,067, issued Aug. 1, 1967, to Weyenberg are suitable bonding compositions which patent is hereby incorporated by reference to describe such elastomeric silicone compositions. Another type of suitable composition is described in U.S. Pat. No. 3,189,576, issued June 15, 1965, to Sweet which describes an oxime containing composition that is a one component room-temperature curing system that cures upon exposure to moisture in the air. This patent is hereby incorporated by reference to describe such elastomeric silicone compositions. Dispersions of such compositions in solvent are commercially available.

Figure 3:
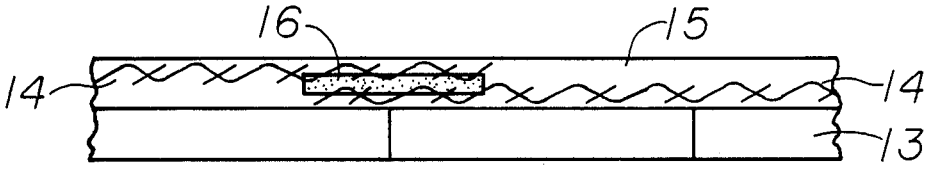
FIG. 3 depicts a seam in the cloth used in the membrane showing the uncoated cloth edges bonded together with adhesive.

A preferred type of liquid elastomeric silicone composition useful as an adhesive is an emulsion, because it can be used without any danger of fire or hazardous fumes, is easily diluted and cleans up with water, and is less costly than solvent dispersions. A preferable silicone emulsion is that disclosed in U.S. Pat. No. 4,221,688, issued Sept. 9, 1980, to Johnson, Saam, and Schmidt, which is hereby incorporated by reference to describe silicone elastomeric compositions which cure by removal of the water from the emulsion. The emulsions are applied to the adjoining surfaces of the cloth at the seam, then the surfaces are pressed together and the emulsion allowed to dry and cure, bonding the pieces of cloth together. FIG. 3 illustrates pieces of uncoated cloth 14, applied over the insulation 13, and bonded together at a seam by means of adhesive 16.

The cloth is adhered to the roof surface, at least in a continuous band at all edges and projections. The means of adhering the cloth to the roof can be by mechanical means, such as by placing the cloth edge under a metal flashing and then attaching the flashing in the usual manner with mechanical fasteners. The cloth can also be adhered to the roof by adhesive bonding. The adhesive used must bond to both the roof surface and the cloth being used. In addition, it must cure at ambient conditions. A preferred adhesive is an elastomeric silicone composition, or a styrene-butadiene modified asphalt emulsion.

The same elastomeric silicone compositions discussed above for bonding the cloth seams can be used for adhering the cloth to the roof. The cloth can be bonded by use of a commercial elastomeric silicone caulk. The caulk is extruded from its storage tube onto the roof surface at the edge, then the cloth is pressed down over the bead of caulk. When the caulk cures, it bonds the cloth to the roof surface. In some cases, depending upon the nature of the roof surface and the type of caulk being used, it may be necessary to first prime the roof surface before applying the caulk. The caulk manufacturer's instructions will tell on which surfaces a primer is necessary.

A liquid elastomeric silicone composition can be used for adhering the cloth to the roof by applying the composition by spraying, brushing, or rolling onto the roof surface, then pressing the cloth edge into the wet composition. When the composition cures, the cloth edge is adhered to the roof surface. The suitable liquid elastomeric compositions are those discussed above as suitable for bonding the cloth seams.

The cloth is also adhered to projections through the roof surface. Suitable cloth sleeves and flashings are fashioned and bonded to the cloth covering the roof and to the surface of the projections so that an unbroken layer of cloth covers the roof surface and then comes up onto any projections, such as vents, pipes, or parapets. Expansion joints should also be constructed in the usual manner, then have cloth adhered to their vertical surfaces. The edges of the cloth will be subsequently covered with counter flashing in the same manner as is currently used with conventional built-up roof constructions. When this step is completed, a cloth layer covers the entire roof surface and extends up onto any projections, expansion joints, walls, etc. There are no unbonded seams present in the cloth layer.

The layer of cloth is adhered in a continuous band at all outer edges to the underlying surface. The continuously adhered outer edge assures that water will not be able to penetrate under the finished membrane.

The continuous layer of cloth is then converted into a single, water impermeable membrane by coating the cloth with a liquid elastomeric silicone composition. Sufficient composition is applied in one or more coats so that an impervious coating 15 is formed upon drying and curing of the composition as in FIG. 3 or FIG. 7. The composition can be applied to the cloth by any convenient method such as spraying, brushing, rolling, or flooding and squeegeeing. The preferred method is spraying. It is preferred that the coating be applied in at least two coats, drying the first coat before applying the second. It is easier to assure that no leaks or pinholes are present in the coating if multiple coats are applied. A more uniform coating results if two coats are applied at right angles to each other.

A preferred embodiment of the above described method makes use of a wash coated, thermally treated cloth 50 such as is shown in FIG. 5, and described above. This cloth 50 is factory coated on the thermally treated surface with a coating 51 of elastomeric silicone composition, except at the edges 52, which is applied and cured under factory conditions. This construction allows the pieces of cloth used to cover a large roof to be bonded together at the seams by bonding the uncoated cloth edges together to yield a single bonded piece of cloth covering the entire roof. This bonding method reduces the possibility of leaks developing in the roof covering. At the same time, the coating 51 allows the production of the impervious coating to produce the water impermeable membrane as discussed above while using less total amount of silicone elastomeric composition. Much less of the liquid silicone elastomeric composition is applied during the coating of the cloth on the roof, step (D), because the majority of the surface already has had a wash coat applied to yield the layer 51. By applying the wash coat in a factory operation, different coating methods can be used than are used after the cloth is bonded together on the roof. By coating the thermally treated cloth with a high viscosity liquid elastomeric silicone composition, such as by knife coating, a thin coat of the composition is applied to the surface without having it flow down through the cloth. This wash coat reduces the porosity of the surface of the cloth which will be subsequently coated to produce the waterproof membrane. The porosity is reduced at least 50 percent. The wash coat does not necessarily produce a solid, impermeable coating, but merely partially seals the pores in the surface of the cloth to which it is applied. The amount of material used in the wash coat will depend upon the cloth used. For a non-woven polypropylene cloth of a nominal 0.136 $kg/m^2$ and a thickness of about 2 mm, the preferred amount of coating material is between 0.068 to 0.34 $kg/m^2$, with about 0.14 $kg/m^2$ most preferred. The combination of the factory applied wash coating and subsequent coatings applied on the roof, step (D), after the bonding of the seams, allows the production of a water impermeable membrane using less coating material because of the reduced tendency of the liquid being coated in step (D) to flow down into the unimpreganted cloth.

A preferred method of applying a weatherproof covering over a roof comprises applying a continuous layer of adhesive over the roof surface over an area to be covered by the first piece of cloth to be used. The first piece of unimpregnated, elastic non-woven thermoplastic cloth, having an upper surface thermally treated to remove projecting fibers and having been previously wash coated with elastomeric silicone composition which is then cured, is layed over the adhesive. The adjoining portion of the roof surface is coated with a continuous layer of adhesive as is the upper surface of the previously applied wash coated cloth at the seam area, the adhesive being applied to the uncoated cloth. While the adhesive is tacky, a second piece of cloth is layed over the adhesive, the second piece of cloth overlapping the first piece of cloth at the seam area to form a bonded seam. These steps are alternately applied until the entire roof surface is covered with a single layer of cloth bonded together at all seams and adhered to the roof surface. Additional pieces of cloth are adhered to all projections through the roof surface in the manner discussed above. At this point in the method the cloth covering the roof already has the wash coat of silicone elastomeric composition covering the area other than the seams. All of the seams are bonded together, creating a single continuous layer of cloth. This single layer of cloth is then converted into a water impermeable membrane by coating the cloth with a liquid, elastomeric silicone composition as discussed above and curing under atmospheric conditions.

Figure 7:
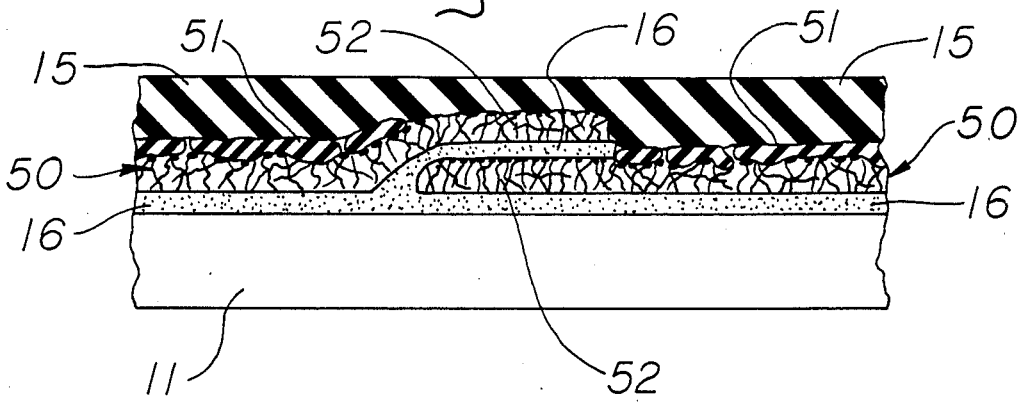
FIG. 7 is a cross section of a portion of roof covered with the cloth of FIG. 5, located at a seam, showing the uncoated edges of the cloth bonded together with adhesive, the adhered pieces of wash coated cloth then being further coated.

The above preferred method yields a construction illustrated in part at FIG. 7. This figure shows a cross section of a weatherproof covering over a roof 11. Adhesive 16 bonds the untreated side of the wash coated, thermally treated cloth 50 to the upper surface of the roof. The uncoated edges 52 of the two pieces of cloth have been bonded together by the adhesive 16. The thermally treated surface of the cloth 50 has been wash coated to give coating 51 to reduce the porosity of the upper surface of the cloth. The pieces of cloth 50, now bonded together at their edges to form a single piece of cloth are coated with liquid, elastomeric silicone composition which cures to form the coating 15 which is water impermeable. The single ply of cloth 50, coated with the cured impermeable coating 15 forms a water impermeable membrane over the roof 11.

The liquid elastomeric silicone composition useful for coating the cloth is the same as that discussed above as useful for bonding the cloth edges together. It is not necessary that the same composition be used for steps (B), (C), and (D). For instance, the cloth seams can be bonded by brushing a layer of liquid, solvent dispersed, elastomeric silicone composition on the adjoining cloth surfaces, pressing the cloth together, then allowing the solvent to evaporate and the composition to cure. The edges of the cloth can then be adhered by extruding a caulk type elastomeric silicone composition onto the roof surface in a continuous band and pressing the cloth edges into the caulk. On curing of the caulk, the cloth edges are continuously adhered to the roof. Then the cloth layer can be sprayed with an elastomeric silicone aqueous emulsion to yield a water impervious coating on the cloth. Because the emulsion type liquid elastomeric silicone composition does not give off any flamable or hazardous fumes on drying, the emulsion is preferred for coating the cloth. The preferred emulsion is that described by U.S. Pat. No. 4,221,688, incorporated above.

The elastomeric silicone emulsion preferred in this invention comprises (a) 100 parts by weight of an anionically stabilized, hydroxyl endblocked polydiorganosiloxane, present as an oil-in-water emulsion, (b) from 1 to 150 parts by weight of colloidal silica, (c) from 0 to 200 parts by weight of filler other than colloidal silica, and (d) from 0.1 to 2.0 parts by weight of aklyl tin salt, said silicone emulsion having a pH of 9 or greater. Such elastomeric silicone emulsions are commercially available.

The hydroxyl endblocked polydiorganosiloxanes useful in the elastomeric silicone emulsion are those which can be emulsified and which will impart elastomeric properties to the product obtained after the removal of water. The best physical properties are obtained when the weight average molecular weight of the polymer is above 50,000. The preferred molecular weights are in the range of 200,000 to 700,000. The most preferred hydroxylated polydiorganosiloxanes are those prepared by the method of anionic emulsion polymerization described by Findley et al. in U.S. Pat. No. 3,294,725, issued Dec. 27, 1966, which is hereby incorporated by reference to show the methods of polymerization and to show the hydroxyl endblocked polydiorganosiloxane in emulsion. The anionic surfactants used are preferably the salt of the surface active sulfonic acids used in the emulsion polymerization to form the hydroxyl endblocked polydiorganosiloxanes as shown in U.S. Pat. No. 3,294,725, cited above which is hereby incorporated by reference to show the surface active sulfonic acids and salts thereof.

Colloidal silica is a required ingredient in the preferred emulsion. The silicone emulsion does not yield a cured film upon drying if the colloidal silica is not present in the composition. Any of the finely divided colloidal silicas that are capable of being dispersed in the silicone emulsion can be used. Preferred are the colloidal silicas available as colloidal silica dispersions in water. The preferred amount of colloidal silica is from 10 to 50 parts by weight.

An alkyl tin salt, preferably a dialkyltindicarboxylate, is used to reduce the storage time between the preparation of the silicone emulsion and the time an elastomeric product can be obtained from the silicone emulsion by removal of the water under ambient conditions to an acceptable range of one to three days. Dialkyl tin salts can be used in amounts of from 0.1 to 2.0 parts by weight for each 100 parts by weight of the hydroxyl endblocked polydiorganosiloxane, preferably about 0.1 to 1.0 parts by weight. Dialkyltincarboxylates which are preferred include dibutyltindiacetate, dibutyltindilaurate, and dioctyltindilaurate.

Another useful ingredient for addition to the silicone emulsion is a filler other than colloidal silica. Such fillers can be added to provide pigmentation which can be used, for example, as a colorant or as an ultraviolet light screening agent. Other fillers can be used as extending fillers which can be used to reduce the cost per unit of the elastomeric product. Examples of fillers other than colloidal silica include carbon blacks, titanium dioxide, clays, aluminum oxide, quartz, calcium carbonate, zinc oxide, mica, and various colorant pigments.

The preferred method of preparing the elastomeric silicone emulsion is to prepare an emulsion polymerized, hydroxyl endblocked polydiorganosiloxane using an anionic surfactant, add the colloidal silica, and then adjust the pH within the range of 10.5 to 11.5 inclusive. The preferred method of adjusting the pH has been found to be with a basic compound such as an organic amine, an alkali metal hydroxide, or a combination thereof. A preferred organic amine is diethylamine. A preferred alkali metal hydroxide is sodium hydroxide. After adjustment of the pH, the alkyl tin salt is added.

Further particulars on the preferred elastomeric emulsion used in the method of this invention are found in U.S. Pat. No. 4,221,688 incorporated above. Preferred elastomeric silicone emulsions have a solids content of from 35 to 80 percent by weight and a viscosity of from about 15 Pa·s to about 60 Pa·s at 25° C. An emulsion with a solids content of 40 percent by weight and a viscosity of 25 Pa·s at 23° C. has been found useful for coating a non-woven polypropylene cloth of about 1.0 mm thickness. The emulsion can be applied in one or more coats to build up the desired coating. An emulsion with a solids content of 67 percent by weight and a viscosity of 60 Pa·s at 23° C. has also been found suitable for this fabric. The high viscosity, higher solids emulsion does not penetrate into the fabric as far as does the lower viscosity material. A spun bonded, non-woven polyester fabric having a thickness of 0.2 mm worked well with the 40% solids material discussed above. The emulsion was fluid enough to flow down through the fabric to the underside. By using an emulsion with a low enough viscosity, in sufficient amount, the cloth can be bonded to the roof surface wherever desired by coating the cloth and allowing the coating to flow down through the cloth to the underlying surface. Subsequent coats of the same emulsion or a different emulsion are then applied to further coat the cloth and form a water impervious membrane over the roof surface.

Additional layers of cloth can be applied in areas subjected to potential damage, such as walkways and around roof-mounted equipment, such as air conditioners or ventilating fans. The area to be reinforced can be coated with elastomeric silicone composition, the additional layer of cloth applied, and the cloth coated with additional elastomeric silicone composition. Upon drying and curing, the additional cloth layer would be bonded to the underlying layer.

The membrane can be finished by adding a layer of sand or roofing granules over the last coat of elastomeric silicone composition while it is still wet. Such a coating provides abrasion resistance, flame resistance, and changes the appearance of the roof surface. The surface is less slippery when wet when the last coat is treated in this manner.

The method of this invention, as described above, produces a weatherproof roof manufactured in place. The liquid water impermeable membrane is manufactured in place using readily available equipment and unskilled labor. The liquid water impermeable membrane is attached to the roof surface at all edges in a continuous band so that no water can get under the membrane. The membrane has no exposed seams which can later develop leaks. All seams in the cloth are bonded together before the membrane is formed. The elastomeric silicone composition which is used to form the membrane gives the membrane the ability to withstand the effects of the temperature induced expansion and contraction of the roof structure under the membrane.

The following examples are included for illustrative purposes only and should not be construed as limiting the invention which is properly set forth in the appended claims.

EXAMPLE 1

A house roof was covered following the method of this invention. The upper roof surface was expanded polystyrene foam insulation board. Sheets of non-woven polypropylene cloth of about 1 mm thickness were rolled out to cover the insulation board surface. The sheets were placed first at the lower edge of the roof. Then subsequent sheets were placed overlapping each at the seams about 10 to 20 cm. The overlapping seams were bonded together by heat fusing. An electric hot air blower heated the fibers to their fusing temperatures, then a roller pressed the hot areas together and cooled the fibers, yielding an overlapped seam with the pieces of cloth fused together. The edges of the cloth at the roof perimeter were bonded to a copper drip edge by using a commercially available silicone rubber caulking composition. The caulking composition was extruded from its storage tube onto the copper drip edge, then the overlying cloth was pressed down over the bead of caulking composition. The caulking composition cured by exposure to the moisture in the air into an elastomeric silicone composition which bonded the cloth to the copper drip edge.

As the cloth was rolled out over the roof, the cloth pieces were fitted over and around the projecting vents and chimney. The cloth was bonded to all such projections by use of the same caulking composition used to bond the cloth at the roof perimeter. At this point, the roof covering was a single piece of cloth, bonded to the roof in a continuous band at all edges and projections, the cloth being composed of several individual pieces bonded together at the seams.

The cloth was then coated by spraying with an aqueous elastomeric silicone emulsion. The emulsion was prepared by first preparing an anionically stabilized emulsion polymerized polydimethylsiloxane containing about 58 percent by weight of hydroxyl endblocked polydimethylsiloxane having a weight average molecular weight of about 324,000. This aqueous emulsion was anionically stabilized with the sodium salt of dodecylbenzenesulfonic acid present in an amount of about one percent based upon the weight of the emulsion.

The elastomeric silicone emulsion was then prepared by first mixing 100 parts by weight of an aqueous sodium stabilized colloidal silica dispersion, having about 15 percent by weight silica, with 2 parts by weight diethylamine. Then 167 parts by weight of the above described emulsion of polydimethylsiloxane was added. Next, 0.3 part by weight of antifoam emulsion and 1 part by weight of a 50 percent by weight emulsion of dioctyltindilaurate were mixed until uniform. Then 10 parts by weight of an acrylic thickening agent was mixed in until a uniform mixture resulted. The silicone emulsion had a viscosity of about 25 Pa·s at 23° C., a pH of about 11, and a solids content of about 40 percent by weight.

The emulsion was sprayed onto the cloth using a commerical airless spray gun at a rate sufficient to thoroughly coat the surface of the cloth. This coating was allowed to air dry overnight.

A second coat of the emulsion was sprayed over the first coat the next day. While still wet, the surface was coated with water-washed sand by hand broadcasting. Before the emulsion had a chance to dry, a heavy rain storm destroyed the second coat of emulsion. The destroyed coating, sand, and rain water were then cleaned off the roof and the roof was allowed to dry.

Because of low air temperatures and continuing threat of rain, a liquid elastomeric silicone composition that cured on exposure to the moisture in the air was then used as a top coat on the roof in place of the emulsion that was destroyed by the rainfall. This solvent dispersion was prepared by first mixing 93.2 parts by weight of a hydroxyl endblocked polydimethylsiloxane fluid having a viscosity of about 13.5 Pa·s, 16.8 parts by weight of a hydroxy endblocked polydimethylsiloxane fluid having a viscosity of about 0.8 Pa·s, and 20 parts by weight of naphtha. Then 18 parts by weight of pigment grade titanium dioxide and 100 parts by weight of calcium carbonate were mixed in as fillers. The mixing was carried out in a sealed mixer so that the filler could be well dispersed under high shear conditions without allowing the mixture to become saturated with air and moisture. The dispersion was then finished by the addition of 10 parts by weight of methyltrimethoxysilane and 2 parts by weight of tetraisopropyltitanate. This addition was made in a manner that excluded the mixture from exposure to moisture in the air. The catalyzed mixture was then packaged in moisture proof, sealed pails.

The solvent dispersion was applied to the cloth as a second coat by spreading it over the cloth surface with paint rollers. After the solvent dispersion was uniformly applied over the previously coated cloth, the coating was allowed to dry and then cure by exposure to the moisture in the air. The coated cloth formed a membrane impervious to liquid water, the cloth being bonded at its outer edges in a continuous band to the underlying insulation. Since the cloth seams were first bonded and then the coating was applied, the upper surface of the finished membrane was a continuous coating of elastomeric silicone elastomer with no interruptions or discontinuities in the coating. Water could not penetrate under the membrane at the outer edges or at projections since the cloth was bonded to the underlying surface at all such points. The roof covering is expected to have a long service life since the elastomeric silicone is known to be weather resistant.

EXAMPLE 2

An industrial roof of concrete was covered using the method of this invention.

The concrete roof deck was first sealed by rolling on a coating of an aqueous liquid elastomeric silicone emulsion which had been previously prepared.

A silicone emulsion was prepared by first mixing 6.3 parts by weight of a sodium stabilized colloidal silica dispersion having 15 percent by weight silica with 0.7 part by weight of diethylamine. Then 63.6 parts by weight of the above emulsion of polydimethylsiloxane of Example 1 was mixed with the silica mixture. Next 0.2 part of silicone antifoam, 0.2 part of propylene glycol, 0.9 of carbon black pigment, and 0.4 part of a 50 percent by weight dioctyltindilaurate emulsion were mixed until uniform. Then 27.7 parts by weight of kaolin clay filler was mixed into the uniform mixture. The emulsion had a viscosity of 60 Pa·s at 23° C. and a solids content of 67 percent by weight. The pH of the emulsion was 11.5.

The roof was then covered with polystyrene foam insulation board held in place with mechanical fasteners. The insulation board was then primed with a commercial primer containing tetrabutyltitanate and normal propylorthosilicate.

The primed insulation board was sprayed with a coating of the silicone elastomeric emulsion of Example 1. While the coating was wet, it was covered with non-woven polypropylene cloth having a thickness of about 1 mm. When the emulsion dried, the cloth was found to be bonded to the insulation board.

The cloth was then sprayed with a coating of the same emulsion in an amount sufficient to thoroughly wet the surface of the cloth. The emulsion penetrated into the cloth about half way through its thickness. After this first coating dried, a second coat was applied consisting of the first silicone emulsion described above. This coating was then allowed to dry and cure. The method provided a water impervious membrane, bonded to the insulation board, that had no exposed seams, was elastomeric in nature, and had a long life expectancy when exposed to the weather.

EXAMPLE 3

A building having a 3,000 square foot, built up asphalt-gravel roof was coated using the method of this invention.

Excess, loose gravel was first removed from the roof surface. Then the roof surface was covered with 25.4 mm thick urethane insulation board having an aluminum foil backing. The insulation board was fastened to the roof surface by nailing, with metal washers under the nail heads.

The cloth used was about 2 mm thick, non-woven polypropylene in rolls of 1.8 meter width, weighing a nominal 0.135 g/m$^2$. The surface of the fabric which was to be coated had been exposed to infra-red heaters to melt the fibers projecting above the surface to cause them to collapse onto the surface, producing a thermally treated surface not having a fuzzy texture. After the thermal treatment of the cloth surface, this surface was knife coated with elastomeric silicone emulsion. The elastomeric silicone emulsion had a non-volatile content of about 70 percent by weight and a viscosity of about 30 Pa·s at 23° C. The silicone emulsion was prepared by first mixing about 82 percent of the anionically stabilized emulsion polymerized polydimethyl-siloxane of Example 1 with about 9.5 percent of an aqueous sodium stabilized colloidal silica dispersion, having about 50 percent by weight silica, and with 0.95 percent diethylamine. Next 0.14 percent of antifoam emulsion, 0.24 percent of propylene glycol, 6.2 percent of titanium dioxide slurry of 40 percent solids, and 0.24 percent of a 50 percent emulsion of dioctyltindilaurate were admixed until uniform. Then 0.95 percent of a 28 percent solids acrylic thickening agent was added and the mixture mixed until uniform. This mixture was then processed further by combining about 72.2 percent by weight of this mixture with 27.5 percent finely divided calcium carbonate, 0.2 percent carbon black, and 0.1 percent antifoam, to give the elastomeric silicone emulsion. Sufficient emulsion was used to yield a wash coat on the cloth fibers which partially sealed the cloth surface. The coating material covered the fibers for a distance of less than 50 percent of the cloth thickness. The coating amounted to about 135 g of cured coating per square meter of cloth surface. The outer 150 mm at the edges of the cloth were not coated with the silicone emulsion.

A 1.8 meter strip of the insulation board at the lower edge of the roof was coated with a styrene-butadiene modified asphalt adhesive at a rate of about 0.5 L/m$^2$. A strip of the above described cloth was then placed over the adhesive while it was adherent. The next 1.8 meter strip of roof was then coated with the adhesive as well as the uncoated 150 mm strip along the edge of the piece of cloth which had been previously applied to the roof surface. A second piece of cloth was applied over the adhesive, overlapping the first piece of cloth for 150 mm at the seam. The first and second pieces of cloth were thus bonded securely together at the seam because the two surfaces facing each other were coated by the adhesive and there was no silicone coating on either surface at the seam. This procedure was repeated until the entire roof was covered with cloth, bonding all the seams together as the pieces of cloth were applied and adhering to the underlying insulation layer.

The projections through the roof surface were then covered by cutting pieces of polypropylene cloth, which had been thermally treated but not wash coated, to fit as required. The pieces of fitted cloth were bonded to the surface of the projections and the surface of the coated cloth covering the roof around the projections to provide a continuous bonded cloth surface from the roof surface and extending up the surface of the projections.

The entire surface of the cloth was then spray coated with the elastomeric silicone emulsion described above. After the first coat had cured at ambient conditions a second coat was sprayed on at right angles to the first coat to yield an impervious waterproof coating after curing under ambient conditions. The two coatings of silicone emulsion were applied at a total rate of about 1 $L/m^2$.

The method provided a water impermeable membrane bonded to the roof surface, with all seams between pieces of cloth being bonded together by adhesive at the uncoated edges before the wash coated fabric was finally coated to create the water impermeable membrane.

That which is claimed is:

1. A method of applying a weatherproof covering over a roof comprising (A) laying a piece or pieces of unimpregnated, elastic non-woven thermoplastic cloth, having an upper surface thermally treated to remove projecting fibers, in which the thermally treated upper surface of the cloth is wash coated with liquid, elastomeric silicone composition except for any surface at the cloth edges which will subsequently be bonded at any seams, the coating being applied so that the coating material does not penetrate through more than the upper 50 percent of the cloth thickness, the coating being cured before application of the coated cloth to the roof surface, over the roof, (B) bonding the pieces of cloth together at any seams, (C) adhering the cloth to the roof surface, at least in a continuous band at all edges and projections, then (D) coating the cloth with a liquid, elastomeric silicone composition in sufficient amount so that the coated cloth forms a water impermeable membrane when cured, the composition being curable under atmospheric conditions, to produce a weatherproof roof.

2. A method of applying a weatherproof covering over a roof comprising (A) laying a piece unimpregnated, elastic non-woven thermoplastic cloth, having an upper surface thermally treated to remove projecting fibers, in which the thermally treated upper surface of the cloth is wash coated with liquid, elastomeric silicone composition except for any surface at the cloth edges which will subsequently be bonded at any seams, the coating being applied so that the coating material does not penetrate through more than the upper 50 percent of the cloth thickness, the coating being cured before application of the coated cloth to the roof surface, over the roof, (B) adhering the cloth to the roof surface, at least in a continuous band at all edges and projections, then (C) coating the cloth with a liquid, elastomeric silicone composition in sufficient amount so that the coated cloth forms a water impermeable membrane when cured, the composition being curable under atmospheric conditions, to produce a weatherproof roof.

3. A method of applying a weatherproof covering over a roof comprising (A) laying pieces of unimpregnated, elastic non-woven thermoplastic cloth, having an upper surface thermally treated to remove projecting fibers, in which the thermally treated upper surface of the cloth is wash coated with liquid, elastomeric silicone composition except for any surface at the cloth edges which will subsequently be bonded at any seams, the coating being applied so that the coating material does not penetrate through more than the upper 50 percent of the cloth thickness, the coating being cured before application of the coated cloth to the roof surface, over the roof, (B) bonding the pieces of cloth together at all seams, (C) adhering the cloth to the roof surface, at least in a continuous band at all edges and projections, then (D) coating the cloth with a liquid, elastomeric silicone composition in sufficient amount so that the coated cloth forms a water impermeable membrane when cured, the composition being curable under atmospheric conditions, to produce a weatherproof roof.

4. A method of applying a weatherproof covering over a roof comprising (A) applying an adhesive to the roof surface, there being a layer of adhesive at least in a continuous band at all edges and projections, then (B) laying a piece of unimpregnated, elastic non-woven thermoplastic cloth having an upper surface thermally treated to remove projecting fibers over the adhesive while the adhesive is adherent, in which the thermally treated upper surface of the cloth is wash coated with liquid, elastomeric silicone composition except for any surface at the cloth edges which will subsequently be bonded at any seams, the coating being applied so that the coating material does not penetrate through more than the upper 50 percent of the cloth thickness, the coating being cured before application of the coated cloth to the roof surface, then (C) coating the cloth with a liquid, elastomeric silicone composition in sufficient amount so that the coated cloth forms a water impermeable membrane when cured, the composition being curable under atmospheric conditions, to produce a weatherproof roof.

5. A method of applying a weatherproof covering over a roof comprising (A) applying an adhesive to the roof surface, there being a layer of adhesive at least in a continuous band at all edges and projections, then (B) laying pieces of unimpregnated, elastic non-woven thermoplastic cloth having an upper surface thermally treated to remove projecting fibers over the adhesive while the adhesive is adherent, in which the thermally treated upper surface of the cloth is wash coated with liquid, elastomeric silicone composition except for any surface at the cloth edges which will subsequently be bonded at any seams, the coating being applied so that the coating material does not penetrate through more than the upper 50 percent of the cloth thickness, the coating being cured before application of the coated cloth to the roof surface, (C) adhesive bonding the pieces of cloth together at all seams, then (D) coating the cloth with a liquid, elastomeric silicone composition in sufficient amount so that the coated cloth forms a water impermeable membrane when cured, the composition being curable under atmospheric conditions, to produce a weatherproof roof.

6. A method of applying a weatherproof covering over a roof comprising (A) applying an adhesive to the roof surface, there being a continuous layer over the roof surface, then (B) laying a piece of unimpregnated, elastic non-woven thermoplastic cloth having an upper surface thermally treated to remove projecting fibers, in which the thermally treated upper surface of the cloth is wash coated with liquid, elastomeric silicone composition except for any surface at the cloth edges which will subsequently be bonded at any seams, the coating being applied so that the coating material does not penetrate through more than the upper 50 percent of the cloth thickness, the coating being cured before application of the coated cloth to the roof surface over the adhesive while the adhesive is adherent, then (C) coating the cloth with a liquid, elastomeric silicone composition in sufficient amount so that the coated cloth forms a water impermeable membrane when cured, the composition being curable under atmospheric conditions, to produce a weatherproof roof.

7. A method of applying a weatherproof covering over a roof comprising (A) applying an adhesive to the roof surface, there being a continuous layer over the roof surface, then (B) laying pieces of unimpregnated, elastic non-woven thermoplastic cloth having an upper surface thermally treated to remove projecting fibers, in which the thermally treated upper surface of the cloth is wash coated with liquid, elastomeric silicone composition except for any surface at the cloth edges which will subsequently be bonded at any seams, the coating being applied so that the coating material does not penetrate through more than the upper 50 percent of the cloth thickness, the coating being cured before application of the coated cloth to the roof surface over the adhesive while the adhesive is adherent, (C) adhesive bonding the pieces of cloth together at all seams, then (D) coating the cloth with a liquid, elastomeric silicone composition in sufficient amount so that the coated cloth forms a water impermeable membrane when cured, the composition being curable under atmospheric conditions, to produce a weatherproof roof.

8. The method of claim 7 in which steps (A) and (B) are alternated so that a portion of the roof surface is coated with a continuous layer of adhesive, a piece of the coated cloth is layed over the adhesive while the adhesive is adherent; then an adjoining portion of the roof surface is coated with a continuous layer of adhesive as is the upper surface of the previously applied coated cloth at the uncoated seam area, a second piece of coated cloth is layed over the adhesive while the adhesive is adherent, the second piece of coated cloth overlapping the first to form a seam between the two uncoated surfaces, thus performing step (C); the steps being alternately applied until the roof surface is covered; then coating as in step (D).

9. A method of applying a weatherproof covering over a roof comprising (A) laying a piece or pieces of elastic non-woven thermoplastic cloth, having an upper surface thermally treated to remove projecting fibers and having the thermally treated upper surface further wash coated with liquid, elastomeric silicone composition except for any surface at the cloth edges which will subsequently be bonded at any seams, the coating being applied so that the coating material does not penetrate through more than the upper 50 percent of the cloth thickness, the coating being cured before application of the coated cloth to the roof surface, over the roof, (B) bonding the pieces of cloth together at any seams, (C) adhering the cloth to the roof surface, at least in a continuous band at all edges and projections, then, (D) coating the cloth with a liquid elastomeric silicone composition in sufficient amount so that the coated cloth forms a water impermeable membrane, when cured, the composition being curable under atmospheric conditions, to produce a weatherproof roof.

* * * * *